United States Patent [19]

Reynolds

[11] 3,960,382

[45] June 1, 1976

[54] SKI POLE WITH RETRACTABLE POINT

[75] Inventor: Tom Reynolds, Islip, N.Y.

[73] Assignee: Lawrence Peska Associates, Inc., New York, N.Y. ; a part interest

[22] Filed: Sept. 8, 1975

[21] Appl. No.: 611,560

[52] U.S. Cl. ..... 280/11.37 P; 135/53

[51] Int. Cl.[2] ..... A63C 11/22

[58] Field of Search ..... 280/11.37 P, 11.37 Z, 280/11.37 N, 11.37 H, 11.37 B, 11.37 D, 11.37 L; 135/53, 58, 59, 57

[56] References Cited

UNITED STATES PATENTS

| | | | |
|---|---|---|---|
| 1,164,608 | 12/1915 | Care | 135/59 |
| 2,473,158 | 6/1949 | Luekens, Jr. | 280/11.37 P |
| 2,596,733 | 5/1952 | Sibner | 280/11.37 P |
| 3,556,544 | 1/1971 | Hauser | 280/11.37 F |
| 3,637,229 | 1/1972 | Klemm | 280/11.37 P |
| 3,868,122 | 2/1975 | Negi | 280/11.37 B |

*Primary Examiner*—M. H. Wood, Jr.
*Assistant Examiner*—David M. Mitchell
*Attorney, Agent, or Firm*—Jack D. Slobod

[57] ABSTRACT

A ski pole includes an elongated tubular shaft in which is slideably mounted a rod with a threadably retained pointed tip. A coil spring acting axially between the rod and shaft urges the rod to a position with the pointed end retracted. A handgrip portion of the shaft has an actuating button passing therethrough which projects axially from the rod. The pointed end is deployed by the depression of the button and a trigger pivotly mounted through the handgrip portion locks the rod with the point deployed by a wedging action.

4 Claims, 2 Drawing Figures

SKI POLE WITH RETRACTABLE POINT

FIELD OF THE INVENTION

The present invention relates generally to a ski pole having a retractable point. In its particular aspects the present invention relates to a ski pole having means located on the handgrip for selectively deploying or retracting the point and for locking the point in a deployed position.

BACKGROUND OF THE INVENTION

The sharp pointed end of a ski-pole not only provides a hazard that an individual will inadvertently be jabbed thereby but also the pointed ends are frequently damaged. There have been some attempts in the prior art to provide retractable ski pole points to minimize injury to other skiers. Such devices, as illustrated in U.S. Pat. No. 2,596,733 to Sibner have the disadvantage of requiring continued hand pressure on the ski point deployment control to maintain the point deployed.

OBJECTS OF THE INVENTION

It is an object of the present invention to provide a ski pole with a retractable point which has hand grip mounted controls for locking the point selectively in either a deployed or retracted position.

It is a further object of the present invention to provide a ski pole having a replaceable point.

SUMMARY OF THE INVENTION

Briefly, the aforementioned and other objects of the present invention are satisfied by slideably mounting a rod within a tubular shaft. The rod at one end has a removeably retained pointed end and at the other end has a button portion passing through a hand grip portion of the shaft. The rod is biased to a position with the pointed end retracted within the shaft by a compression spring.

A trigger mounted pivotly through the hand grip portion has a camming surface which engages the rod when the button and trigger are simultaneously depressed. The camming surface is configured for being wedged into engagement with the rod by the force of the compression spring to provide a positive locking action.

A leaf spring engaging the trigger urges the trigger out of engagement with the rod when the button is depressed, for unlocking the trigger and enabling the compression spring to retract the pointed end.

Other objects, features and advantages of the present invention will become apparent upon perusal of the following detailed description of the preferred embodiment thereof when taken in conjunction with the appended drawing wherein.

DETAILED DESCRIPTION

Figure 1:
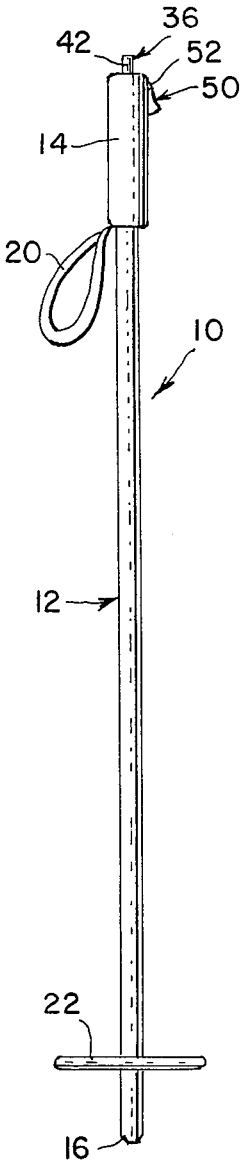
FIG. 1 is an elevation view of the ski pole of the present invention.
Figure 2:
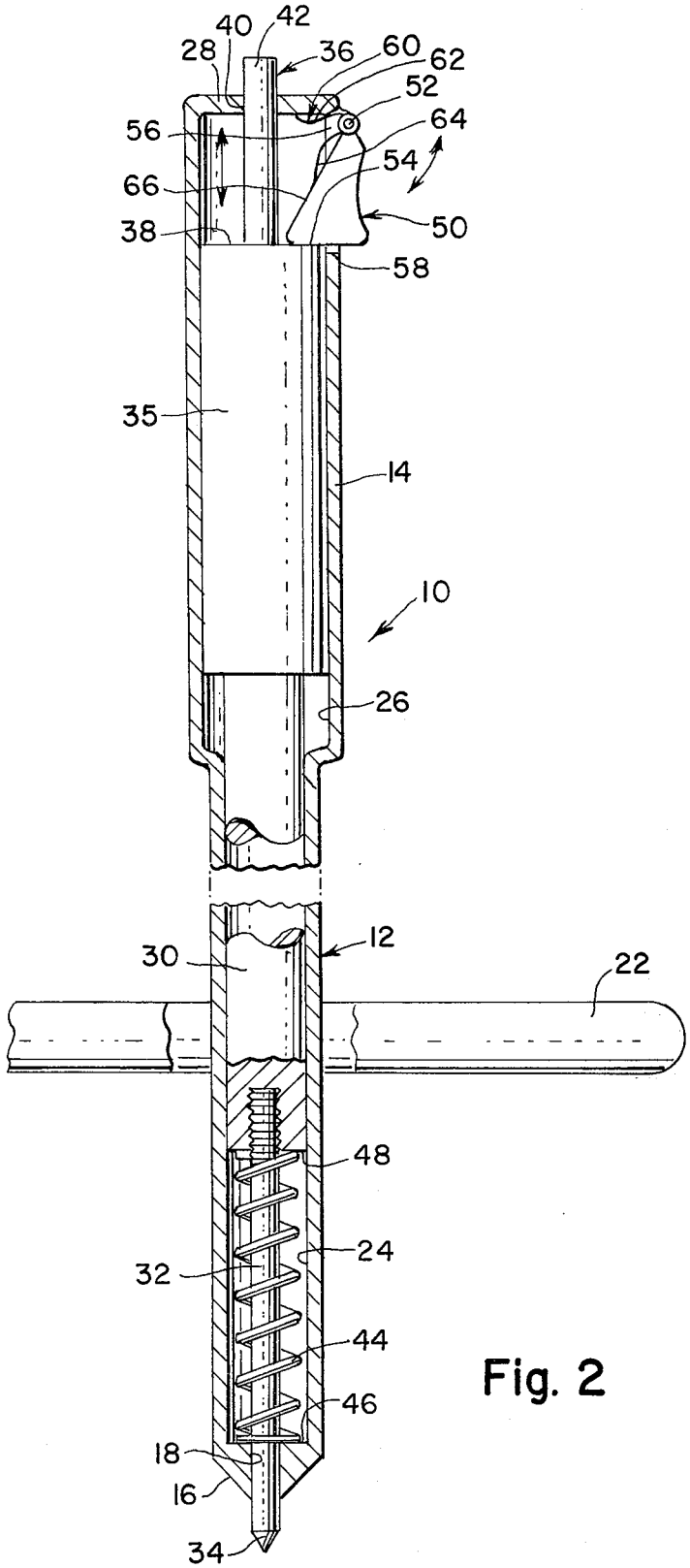
FIG. 2 is a longitudinal cross-sectional view of the ski pole in FIG. 1.

Referring to FIGS. 1 and 2 of the drawing the ski pole 10 of the present invention comprises an elongated tubular metal shaft 12 having a cylindrical hand grip portion 14 of enlarged diameter at a top end thereof and having a frusto-conically pointed bottom end 16 with a central bore 18. Ski pole 10 further has a wrist strap 20 secured to hand grip portion 14 and a snow ring 22 secured to shaft 12 near bottom end 16.

The small bore 18 coaxially communicates with a bore 24 of a larger diameter which spans the majority of the length of shaft 12. At the hand grip portion 14, the bore 24 coaxially communicates with a bore 26 of even larger diameter which is closed by an end wall 28 forming the top of ski pole 10.

Within the bore 24 is an elongated slideable rod 30 which is threaded at its bottom end and coaxially receives an externally threaded short rod 32 of reduced diameter having the operative pointed end 34. By providing the rod 32 as removeably and threadably retained in rod 30, the operative point 34 may easily be replaced if damaged.

At the top end of rod 30, an integral cylindrical portion 35 of increased diameter is formed proportioned for sliding in bore 26. A rod 36 of reduced diameter projects coaxially upward integrally from the top end face 38 of portion 35 and passes through a central aperture 40 in end wall 28. As will be understood, the protruding portion 42 of rod 36 forms an actuation button for the selective deployment or retraction of pointed end 34 from the bottom end 16 of the ski pole 10.

A compression spring 44 is positioned in the lower portion of bore 24 acting between the annular shoulder 46 at the junction of bore 24 with bore 18 and the annular shoulder 48 forming the bottom end of rod 30. The spring 44 normally urges the rod 30 upward with top face 38 serving as a stop against end wall 28. In such a position, pointed end 34 is retracted within shaft 12. As should be apparent FIG. 2, pointed end 34 is deployed below bottom end 16 of the shaft 12 by pressing button 42.

For locking the rod 30 with pointed end 34 deployed a trigger 50 is mounted pivotally on the side of handgrip portion 14 and is adapted to be rocked around its pivot 50 to project a camming surface 54 through a slot 56 in the wall of the hand grip portion 14 when the trigger is depressed. This motion is possible if the button 42 is first depressed since then the end face 38 lies below the bottom edge 58 of slot 56.

Then upon releasing button 42 while momentarily still depressing trigger 50, the camming surface 54 is engaged by end face 38 and due to the urging of spring 44, the surface 54 is wedged against the bottom edge 58 of the slot. Now, the hand may be removed from trigger 50 and the rod 30 will be locked in place by this wedging action with pointed end 34 retracted.

The trigger 50 is released by momentarily pressing button 40, to move face 38 downward out of engagement with camming surface 54. To urge the trigger 50 out of bore 26, when released, a leaf spring 60 is provided which comprises a pair of legs 62 and 64 making an acute angle with each other which respectively bear against the underside of end wall 28 and against a back surface 66 of trigger 50.

Having described the preferred embodiment of the present invention in specific detail, it should be understood that numerous modifications, additions and omissions in the details thereof are possible within the intended spirit and scope of the invention.

What is claimed is:

1. A ski pole comprising an elongated tubular shaft having a cylindrical hand grip portion at one end, a rod means slideably mounted in said shaft, said rod means having a generally pointed end adapted to be deployed from the opposite end of said tubular shaft, spring means within said shaft for urging said rod means to a position with said pointed end retracted inside said tubular shaft, actuating button means projecting from said rod means axially through said hand grip portion for deploying said pointed end upon depression of said button means, and means carried by said hand grip portion, and movable radially, for lockably engaging said rod when positioned by said button means with said pointed end deployed.

2. The ski pole of claim 1 wherein said lockably engaging means comprises a trigger element carried pivotly by said hand grip portion in communication with an aperture in said hand grip portion, said trigger element having a camming surface engageable with said rod means, said camming surface being configured to be retained in engagement with said rod means by the force of said spring means.

3. The ski pole of claim 2 further comprising second spring means for urging said trigger element out of engagement with said rod means to enable said trigger element to be released from engagement upon depression of said button means.

4. The ski pole of claim 1 wherein said rod means includes a rod removeably retaining said pointed end to enable said pointed end to be replaced.

* * * * *